United States Patent [19]

Goto et al.

[11] 3,983,697

[45] Oct. 5, 1976

[54] EXHAUST GAS CLEANING SYSTEM FOR INTERNAL COMBUSTION ENGINES

[75] Inventors: Kenji Goto; Norikatsu Ishikawa, both of Susono, Japan

[73] Assignee: Toyota Jidosha Kogyo Kabushiki Kaisha, Toyota, Japan

[22] Filed: July 15, 1974

[21] Appl. No.: 488,662

[30] Foreign Application Priority Data

Jan. 16, 1974 Japan ..... 49-7023

[52] U.S. Cl. ..... 60/277; 60/278; 60/290; 60/306

[51] Int. Cl.[2] ..... F02B 75/10; F01N 3/14

[58] Field of Search ..... 60/277, 289, 290, 307, 60/900, 278, 285, 306

[56] References Cited

UNITED STATES PATENTS

| | | | |
|---|---|---|---|
| 3,733,829 | 5/1973 | Henault | 60/289 |
| 3,748,855 | 7/1973 | Day | 60/290 |
| 3,751,916 | 8/1973 | Hayashida | 60/289 |
| 3,788,070 | 1/1974 | Camarasa | 60/290 |
| 3,799,301 | 3/1974 | Bentley | 60/285 |
| 3,805,522 | 4/1974 | Sheppard | 60/290 |
| 3,812,673 | 5/1974 | Muroki | 60/289 |
| 3,826,089 | 7/1974 | Nakajima | 60/289 |
| 3,849,984 | 11/1974 | Toda | 60/290 |
| 3,869,858 | 3/1975 | Goto | 60/290 |
| 3,872,666 | 3/1975 | Bentley | 60/289 |

*Primary Examiner*—Douglas Hart

*Attorney, Agent, or Firm*—Stevens, Davis, Miller & Mosher

[57] ABSTRACT

Herein disclosed in an exhaust gas cleaning system for an internal combustion engine. The cleaning system comprises a change-over valve having its inlet port communicating with an air pump, its first outlet port communicating with the exhaust system of the engine and its second outlet port communicating with the intake system of the engine through a flow control valve. The change-over valve has communication of its outlet ports switched in accordance with the temperature of a catalytic converter which is disposed in the exhaust system.

In a modification, a duct providing communication between the second outlet port of the change-over valve and the flow control valve is provided to communicate with the exhaust system.

4 Claims, 2 Drawing Figures

EXHAUST GAS CLEANING SYSTEM FOR INTERNAL COMBUSTION ENGINES

BACKGROUND OF THE INVENTION

This invention relates to an exhaust gas cleaning system for an internal combustion engine and, more particularly, to an exhaust gas cleaning system for reducing noxious components in the exhaust gases with use of a catalytic converter disposed in the engine exhaust system, to which secondary air is supplied. In the cleaning system, the secondary air is partly supplied to the engine intake system particularly in the overheating operation of the catalytic converter so as to produce a leaner air-fuel mixture to thereby reduce formation of hydrocarbons (HC) and carbon monoxide (CO).

In the prior art exhaust gas cleaning system equipped with a catalytic converter, upon reaching of a predetermined high temperature of the catalytic converter, the secondary air, which has been supplied in advance to the upstream side of the catalytic converter, is discharged to the atmosphere to stop reactions in the catalytic converter to thereby prevent the overheating thereof.

However, if such catalytic converter primarily for effecting oxidization is used in a reducing atmosphere without supply of the secondary air, it is liable to produce ammonia or other undesired products. Hence, it is desirable to place the exhaust gases in an oxidizing atmosphere with the supply of secondary air even during the overheating operaion of the catalytic converter.

On the other hand, in an engine having an exhaust gas recirculating system, condensation of moisture within the engine is probable, since the exhaust gases are always supplied to the intake system.

SUMMARY OF THE INVENTION

An object of the invention is to provide an exhaust gas cleaning system, in which supply of secondary air to the exhaust system is reduced when the temperature of a catalytic converter reaches a high level with a part of the secondary air being supplied to the intake system, thereby preventing the overheating of the catalytic converter and supplying a leaner air-fuel mixture to the combustion chamber of the engine for reducing the generation of HC and CO. The cleaning system also permits removal of moisture, which might otherwise be produced in the exhaust gas recirculating system.

According to the invention, there is provided an exhaust gas cleaning system for an internal combustion engine which system comprises a catalytic converter provided in the exhaust system of the engine, a change-over valve for providing communication of an air pump either with engine intake system or with the upstream side of the catalytic converter, switching means coactive with the change-over valve for switching the communication of the change-over valve according to the temperature of the catalytic converter, and a flow control valve for controlling opening of a duct which is to provide communication between the change-over valve and the intake system according to the quantity of air taken into the engine.

BRIEF DESCRIPTION OF THE DRAWINGS

Other objects, features and advantages of the invention will become more apparent from the following description made with reference to the accompanying drawings, in which.

DESCRIPTION OF THE PREFERRED EMBODIMENTS

Figure 1:
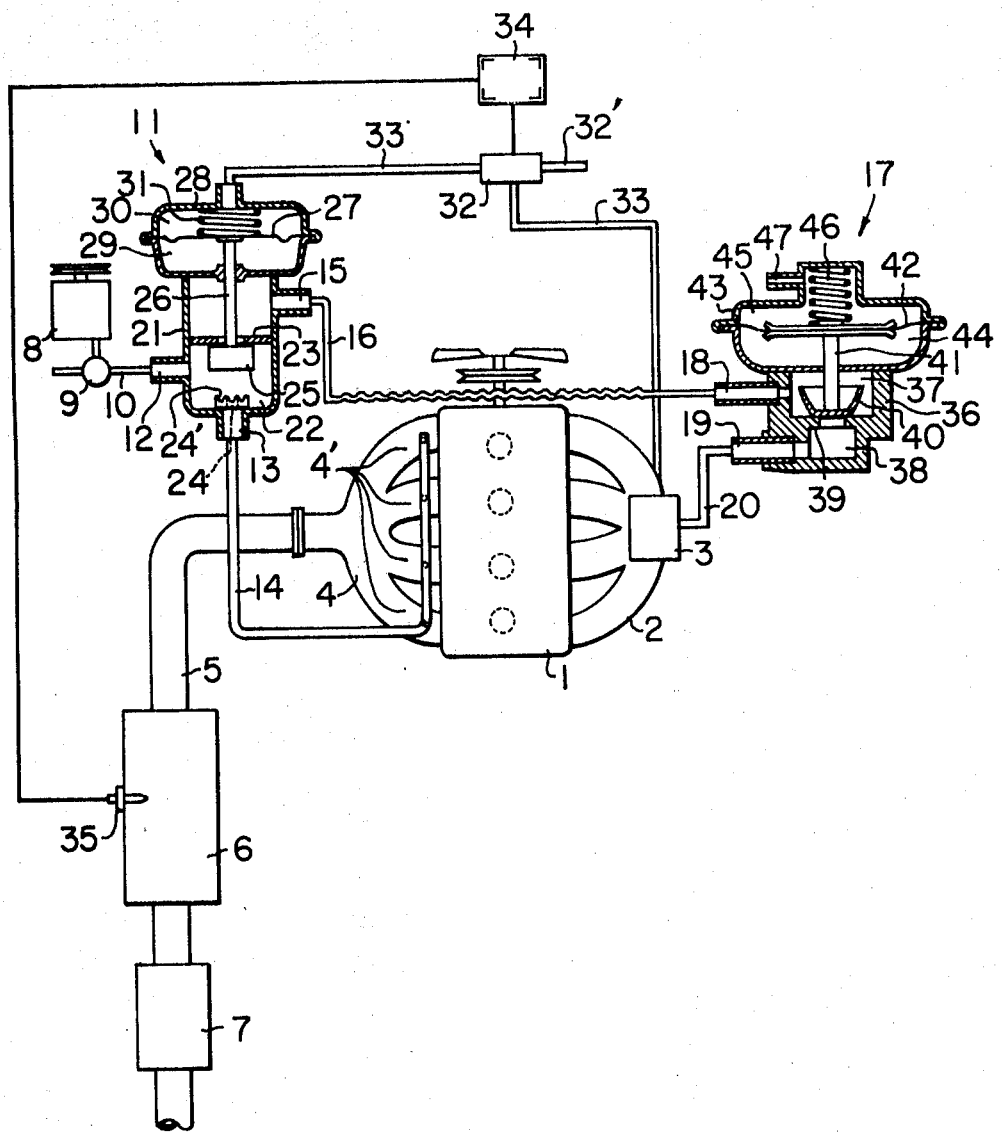
FIG. 1 is a schematic presentation of an exhaust gas cleaning system for an internal combustion engine according to the invention.

The invention will now be described with reference to FIG. 1. Reference numeral 1 designates an engine body having an intake manifold 2 communicating with a carburetor 3 and an exhaust manifold 4 communicating with a duct 5 for guiding the exhaust gases to the atmosphere. A catalytic converter 6 and a muffler 7 are disposed in the duct 5 at the downstream side thereof. The catalytic converter 6 acts to reduce noxious components in the exhaust gases. An air pump 8 communicates with an inlet port 12 of a change-over valve 11 through a duct 10, in which an on-off valve 9 is disposed. The change-over valve 11 has a first outlet port 13 communicating through a duct or conduit 14 with respective branches 4′ of the exhaust manifold 4. Secondary air supplied from the air pump 8 to the exhaust manifold branches 4′ flows along with the exhaust gas to the catalytic converter. The change-over valve 11 has a second outlet port 15 communicating through a duct or conduit 16 with an inlet port 18 of a flow control valve 17. Although not shown, the duct 16 is equipped with a cooling jacket or similar cooling means for cooling the secondary air. The flow control valve 17 has an outlet port 19 communicating through a duct 20 with the intake manifold 2.

The change-over valve 11 will now be described in more detail. Its valve housing 21 is formed with the inlet port 12 and two outlet ports 13 and 15 and defines a valve chamber 22. A valve seat 23 is disposed within the valve chamber 22 to divide the chamber 22 into a section communicating with the inlet port 12 and outlet port 13 and into the other section communicating with the outlet port 15. A valve seat 24 having a passage 24′ is formed at the outlet port 13, and a valve member 25 is interposed between the valve seats 23 and 24. The valve member 25 has a shaft 26 penetrating into the aperture of the valve seat 23 and extending to the outside of the valve housing 21. The extending end of the shaft 26 is secured to a diaphragm 27. The diaphgram 27 is accommodated within a diaphragm case 28 which is secured to the valve housing 21. The chamber of the diaphragm case 28 is divided into an atmospheric pressure section 29 communicating with atmosphere and into a negative pressure section 30. A spring 31 urging the diaphragm 27 is disposed within the negative pressure section 30 such that the valve member 25 is urged against the valve seat 24 by the spring force through the shaft 26. The negative pressure section 30 is made to have communication with the intake manifold 2 through a duct or conduit 33, which is equipped with an electromagnetic control valve 32, so that the negative pressure in the intake manifold 2 acts upon the diaphragm 27. The electro-magnetic control valve 32 has an air vent 32′ open to the atmosphere, and its switching action is controlled by a computer 34. The catalytic converter 6 is equipped with a temperature sensor 35, which transmits a signal representing the heating state of the catalytic converter 6 through a lead wire to the computer 34.

The flow control valve 17 will now be described in more detail. Its valve housing 36 having an inlet port 18 and an outlet port 19 defines an upper chamber 37 communicating with the inlet port 18 and a lower chamber 38 communicating with the outlet port 19. A valve seat 39 is interposed between the upper and lower chambers 37 and 38, and a valve member 40 for controlling opening around the valve seat 39 is disposed in the upper chamber 37. The valve member 40 has a shaft 41 extending to the outside of the valve housing 36 and secured to a diaphragm 42. The diaphragm 42 is accommodated with a diaphragm case 43 secured to the valve housing 36. The diaphragm case 43 has its chamber divided into a section 44 communicating with the secondary air pressure and into an atmospheric pressure section 45. A spring 46 urging the diaphragm 42 is disposed in the atmospheric pressure section 45 such that the valve member 40 is urged against the valve seat 39 by its spring force through the shaft 41. The atmospheric pressure section 45 is made to have communication through a duct 47 with the atmosphere. The diaphragm 42 assumes a position determined by the balance between the spring force of the spring 46 and the secondary air pressure in the section 44, and the valve member 40 controls the opening around the valve seat 39 according to the quantity of the secondary air supplied.

In the operation of the exhaust gas cleaning system of the above construction, when the catalytic converter 6 is under a normal condition or not under the overheated condition, the negative pressure section 30 of the change-over valve 11 is in communication with the intake manifold 2. Under this particular condition, the position of the diaphragm 27 determined both by the negative pressure in the intake manifold 2 and by the spring force of the spring 31 is such that the valve member 25 closes the opening around the valve seat 23, so that the inlet port 12 of the change-over valve 11 is in communication with the outlet port 13. As a consequence, the secondary air flowing from the air pump 8 to the inlet port 12 is supplied through the duct 14 to the respective branches 4' of the exhaust manifold 4. The exhaust gases of the engine flow along with the secondary air through the duct 5 into the catalytic converter 6, where noxious components of the exhaust gases are reduced to discharge cleaned exhaust gases through the muffler 7 to the atmosphere.

When the temperature of the catalytic converter 6 reaches a predetermined high level, the temperature sensor 35 sends out a signal to the computer 34. Upon reception of the signal, the computer 34 switches the electromagnetic control valve 32 to bring the negative pressure section 30 of the change-over valve 11 into communication with the atmosphere. As a result, the diaphragm 27 is urged by the spring 31 to urge the valve body 25 through the shaft 26 thereof, thereby closing the opening around the valve seat 24. However, since the valve seat 24 has a passage 24' beside its opening, the inlet port 12 is allowed to have communication with both the outlet ports 13 and 15. Under this condition, the secondary air flowing from the air pump 8 to the inlet port 12 of the change-over valve 11 partially flows through the outlet port 13 and the duct 14 to the exhaust manifold 4. In this way, the proportion of the exhaust gases, which are reacted in the catalytic converter 6, is reduced, whereby the overheating of the catalytic converter 6 is prevented. Meanwhile, the rest of the secondary air entering the inlet port 12 flows through the opening around the valve seat 23, the outlet port 15 and the duct 16 to the inlet port 18 of the flow control valve 17. The valve member 40 of the flow control valve 17 thus controls the opening around the valve seat 39 according to the quantity of the air supplied to the engine. Thus, the secondary air entering through the inlet port 18 flows through the opening around the valve seat 39, the lower chamber 38, the outlet port 19 and the duct 20 to the intake manifold 2. In this way, about ten percent of the secondary air with respect to the air-fuel mixture supplied to the engine is supplied thereto to make the mixture leaner to thereby reduce the formation of HC and CO.

While, in the preceding embodiment, a portion of the secondary air is supplied to the exhaust system during the overheated condition of the catalytic converter 6, it is also possible to discharge this secondary air to the atmosphere rather than supplying it to the exhaust system.

Figure 2:
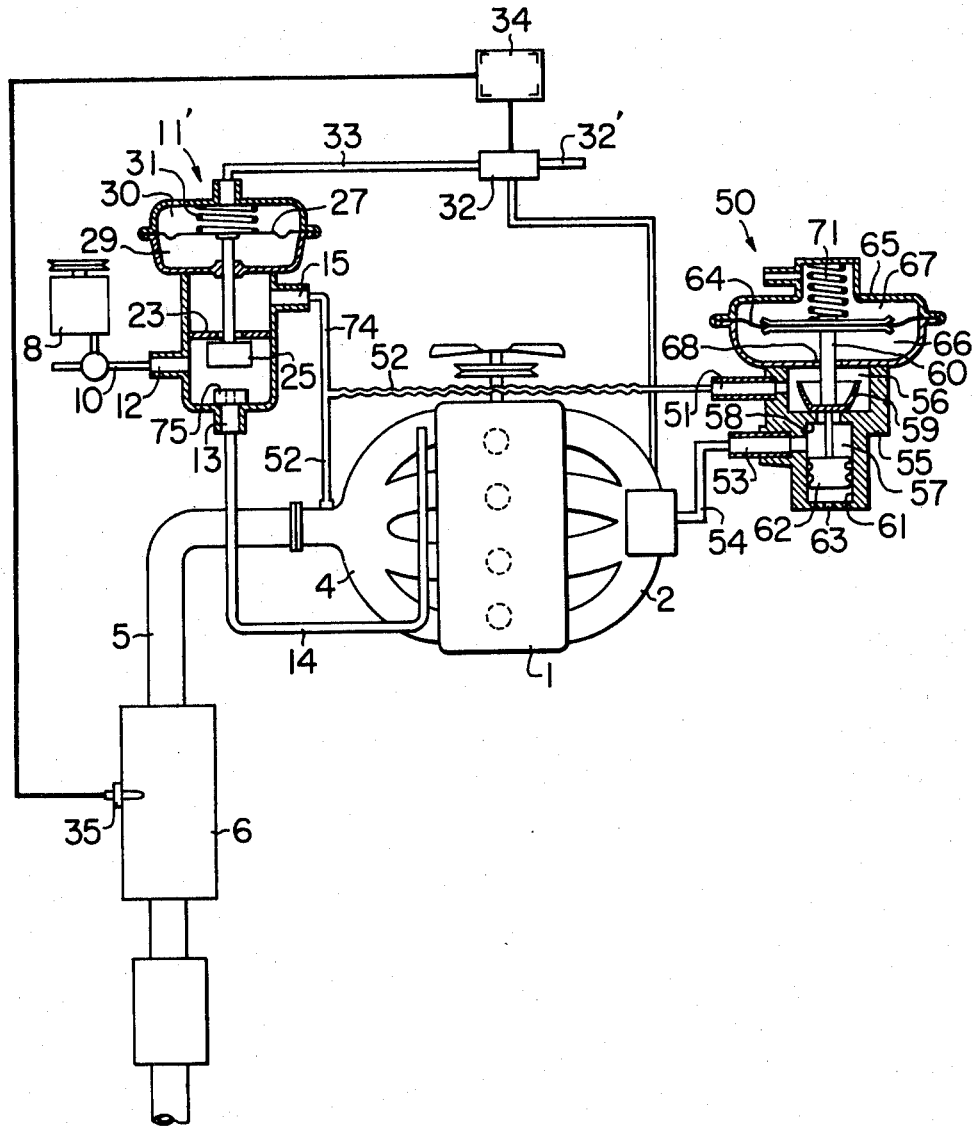
FIG. 2 is a schematic representation of a second embodiment of the exhaust gas cleaning system.

FIG. 2 shows a second embodiment of the exhaust gas cleaning system according to the invention, and this embodiment is applied to an internal combustion engine having an exhaust gas recirculating system. Here, the exhaust manifold 4 of the engine is connected through a duct or conduit 52 to an inlet port 51 of a flow control valve 50, whose outlet port 53 is in turn connected through a duct 54 to the intake manifold 2, whereby a portion of the exhaust gases are made to recirculate to the intake system.

The flow control valve 50 will now be described in more detail. Its valve housing 55 having the inlet port 51 and the outlet port 53 defines an upper chamber 56 communicating with the inlet port 51 and a lower chamber 57 communicating with the outlet port 53. A valve seat 58 is interposed between the upper and lower chambers 56 and 57, and a valve member 59 for closing the opening around the valve seat 58 is disposed in the upper chamber 56. The valve member 59 has a shaft 60 extending through the upper and lower chambers 56 and 57. The lower chamber 57 of the valve 50 terminates in a cylinder 61 equipped with a piston 62, and an aperture 63 vented to the atmosphere is formed at the side of the cylinder 61 opposite to the upper chamber 55 such that both the negative pressure acting upon the valve member 59 and the weight of the shaft 60 are cancelled by the negative pressure and atmospheric pressure acting on the respective opposite sides of the piston 62. The shaft 60 extends to the outside of the upper chamber 56 and has its free end secured to a diaphragm 64, which is accommodated in a diaphragm case 65 secured to the valve housing 55. The chamber of the diaphragm case 65 is thus divided into a positive pressure section 66 close to the upper section 56 and into an atmospheric pressure section 67 remote therefrom. The positive pressure section 66 communicates with the upper chamber 56 through a passage 68, and a spring 71 urging the diaphragm 64 toward the upper chamber 56 is disposed in the atmospheric pressure section 67. The exhaust gases from the exhaust manifold 4 are partically led through the inlet port 51 into the upper chamber 56, whence they are led through the passage 68 into the positive pressure section 66. With the pressure introduced into the positive pressure section 66, the diaphragm 64 is so moved that the valve member 59 opens the clearance around the valve seat 58. Thus, the exhaust gases entering the upper chamber 56 are made to recirculate through the opening around the valve seat 58, the lower chamber 57, the outlet port 53 and the duct 54 to the intake manifold 2, at a flow rate controlled by the flow control valve 50.

The air pump 8 is connected through a duct 10 to the inlet port 12 of a change-over valve 11'. The change-over valve 11' has its first outlet port 13 connected through the duct 14 to the exhaust manifold 4 and its second outlet port 15 connected through a duct or conduit 74 to a duct 52, which has communication with the flow control valve 50. In this embodiment, the change-over valve 11' is formed at the outlet port 13 with a valve seat 75, which has no counterpart such as passage 24' in the valve seat 24 in the change-over valve 11 of the first embodiment. Thus, when the valve seat 75 is closed by the valve member 25, no secondary air flows through the outlet port 13. In other respects, the change-over valve 11' has the same construction as that of the change-over valve 11. The diaphragm 27 is urged by the spring 31 to make the valve member 25 close the valve seat 75, when the temperature of the catalytic converter 6 reaches an overheated level.

In the operation of the exhaust gas cleaning system of the above construction, when the catalytic converter 6 is not in the overheated condition, the inlet port 12 of the change-over valve 11' is in communication with the outlet port 13 with the opening around the valve seat 23 being closed by the valve member 25. Under this condition, the secondary air from the air pump 8 flows through the inlet port 12 and the outlet port 13 of the change-over valve 11' to the exhaust manifold 4. At this instant, such a quantity of the exhaust gases as is controlled by the flow control valve 50 is made to recirculate to the intake manifold 2.

When the temperature of the catalytic converter 6 reaches a predetermined high level, the electromagnetic valve 32 is switched by the computer 34 to introduce atmospheric air into the negative pressure section 30, so that the opening around the valve seat 75 is closed by the valve member 25. As a consequence, the secondary air flowing from the air pump 8 to the inlet port 12 of the change-over valve 11' flows through the opening around the valve seat 23, the outlet port 15, the duct 74 and the duct 52 to the inlet port 51 of the flow control valve 50, whence it flows through the upper chamber 56, the opening around the valve seat 58, the lower chamber 57, the outlet port 53 and the duct 54 to the intake manifold 2. With secondary air being thus supplied to the inlet manifold 2, the air-fuel mixture supplied to the combustion chambers of the engine is made leaner to reduce the formation of HC and CO. In this case, if the air-fuel ratio of the mixture is set from 10 percent of the exhaust gases to 14, an air-fuel ratio of 15.4 can be obtained by supplying ten percent of secondary air in place of the exhaust gases. Since the pressure exerted on the diaphragm 64 by the secondary air pressure is higher than that by exhaust gas pressure, the valve member 59 of the flow control valve 50 opens the clearance around the valve seat 58 to a greater extent than the case of recirculating the exhaust gases. This, however, offers no problem since such secondary air is more advantageous than the exhaust gases in view of the misfire limit.

The secondary air flowing through the outlet port 15 of the change-over valve 11' to the duct 74 is under a higher pressure than the exhaust gases in the exhaust manifold 4, so that, in this case, the exhaust gases will not flow through the flow control valve 50 to the intake manifold 2, but a portion of the secondary air flows through the ducts 74 and 52 to the exhaust manifold 4. Here again, it is possible to discharge the secondary air to the atmosphere rather than supplying it to the exhaust manifold 4.

As has been described in the beforehand, with use of the exhaust gas cleaning system according to the invention, when a predetermined high temperature is attained in the catalytic converter, the secondary air supplied to the upstream side of the catalytic converter is reduced to partially supply it to the intake system, so that the air-fuel mixture supplied to the engine can be made so leaner as to reduce formation of HC and CO in the combustion process of the air-fuel mixture, which is desirable from the standpoint of cleaning of the exhaust gases. Also, the catalytic converter can be prevented from thermal deterioration to make it possible to effectively use the secondary air.

What is claimed is:

1. In an automobile engine having an air intake system including an intake manifold, a catalytic converter, an exhaust system including an exhaust manifold and conduit means connecting said exhaust manifold to said converter, the improvement which comprises:

an air pump;

a change-over valve means, activated by a vacuum from said air intake system, having an inlet port communicating with said air pump, a first outlet port communicating with said exhaust system of the engine upstream of said catalytic converter, and a second outlet port communicating with said exhaust system of the engine upstream of said catalytic converter and communicating with said intake system of the engine via a first conduit, wherein said first conduit is branched with a second conduit extending to said exhaust system upstream of said converter, said second conduit being a means for communicating said second outlet port with said exhaust system; and switching means, coactive with said change-over valve means, for providing selective communication between said inlet port of said change-over valve means and said first and second outlet ports in accordance with the temperature of said catalytic converter, said change-over valve means diverting air from said first outlet port to said second outlet port.

2. The improvement according to claim 1 wherein said first conduit includes a flow control valve means which permits a part of the exhaust gas in said exhaust system to recirculate to said intake system when said second outlet port is closed.

3. The improvement according to claim 1 further including a fan driven by the engine and in which a portion of said first conduit is in heat exchange relationship with the air flow of said fan.

4. In an automobile engine having an air intake system including an intake manifold, a catalytic converter, an exhaust system including an exhaust manifold and conduit means connecting said exhaust manifold to said converter, the improvement which comprises:

a source of air under pressure;

a change-over valve means having an inlet port communicating with said source, a first outlet port, a second outlet port, a valve seat at said first outlet port and having passages of large and small total cross section, and a valve member movable to close said large passages and maintain said small passages open, said change-over valve means selectively connecting said air source through said inlet port to said large passages or said second outlet port and said small passages;

a first conduit connecting said first outlet port to said exhaust system upstream of said converter;

a second conduit connecting said second outlet port to said intake system;

means for controlling said change-over valve means to selectively connect said air source to said first outlet port and said second outlet port, said control means including a third conduit receiving atmospheric air, a fourth conduit connected to said intake system, a fifth conduit connected to said change-over valve means, and means connnecting said fifth conduit to said fourth conduit to control said change-over valve means with vacuum or to said third conduit to control said change-over valve means with atmospheric air; and means, responsive to an abnormality of an operating parameter of said converter and connected to said control means, to cause said control means to activate said change-over valve means to close said large passages and open said second outlet port and said small passages to said air source.

* * * * *